US005131909A

United States Patent [19]

Hangey

[11] Patent Number: 5,131,909

[45] Date of Patent: Jul. 21, 1992

[54] MOLECULAR SIZE OF HYDRODYNAMIC VOLUME OF SULFONATED AROMATIC CONDENSATES USED TO IMPART STAIN RESISTANCE TO POLYAMIDE CARPETS

[75] Inventor: Dale A. Hangey, Midlothian, Va.

[73] Assignee: Allied-Signal Inc., Morris Township, Morris County, N.J.

[21] Appl. No.: 524,601

[22] Filed: May 17, 1990

Related U.S. Application Data

[63] Continuation-in-part of Ser. No. 346,668, May 3, 1989, abandoned.

[51] Int. Cl.[5] ..... D06M 11/00; B32B 3/02; B32B 33/00

[52] U.S. Cl. ..... 8/115.6; 8/115.51; 8/115.54; 8/115.65; 8/929; 252/8.7; 428/95; 428/97

[58] Field of Search ..... 8/115.56, 115.6, 115.54, 8/115.65

[56] References Cited

U.S. PATENT DOCUMENTS

| | | | |
|---|---|---|---|
| 4,501,591 | 2/1985 | Ucci et al. | 8/495 |
| 4,592,940 | 6/1986 | Blyth et al. | 252/8.7 |
| 4,619,853 | 10/1986 | Blyth et al. | 428/95 |
| 4,680,212 | 7/1987 | Blyth et al. | 428/97 |

OTHER PUBLICATIONS

"A Guide to Materials Characterization and Chemical Analysis", edited by John P. Sibilia (VCH Publishers), 1988, pp. 81-84.

*Primary Examiner*—A. Lionel Clingman

[57] ABSTRACT

In a continuous application process with post-steaming, SAC's having molecular size (hydrodynamic volume) defined by elution volume (Ve) determined by Size Exclusion Chromatography (SEC) of between 6.3 and 6.5 ml. using the procedure described, are such that they are not too small so that migration into the fiber occurs (reduces ring dyeing effect) nor are they too large such that they require extremely long steaming times or the use of swelling agents to be effective. This is independent of the degree of sulfonation of the SAC.

10 Claims, 2 Drawing Sheets

MOLECULAR SIZE OF HYDRODYNAMIC VOLUME OF SULFONATED AROMATIC CONDENSATES USED TO IMPART STAIN RESISTANCE TO POLYAMIDE CARPETS

This application is a continuation-in-part of U.S. Ser. No. 346,668 filed in May 3, 1989 now abandoned.

BACKGROUND OF INVENTION

This invention relates to improved sulfonated aromatic condensate (SAC) compositions to enhance the stain resistance of carpet fibers. SAC's used to impart stain resistance are generally synthesized by the condensation of formaldehyde with diphenolsulfone and phenolsulfonic acid (Blyth and Ucci, U.S. Pat. No. 4,592,940). The functionality and reactivities of the monomers are such that a complex mixture containing random sequences is obtained. The presence of the diphenolsulfone promotes cross-linking of the polymer backbones and high molecular weights or sizes.

The SAC's are most effective for promoting stain resistance when concentrated near the fiber surface or "ring-dyed". Therefore, it is necessary to carefully select the type of SAC mixture and tailor its characteristics to the requirements of the fiber morphology and application methods. If not properly designed, the SAC will not impart the desired stain resistant properties at extremes of significant application variable ranges.

The preferred method for application of the SAC stain resist chemistry is by an "aftertreatment", after the carpet is already dyed. The aftertreatment may be either a batch or continuous process. The most commercially significant aftertreatment process involves continuous application of the treatment liquor using a specially designed applicator, such as the Kuster Flex-nip or Otting Thermal Chem, which is then followed by a dwell period at elevated temperature using a short vertical steamer. In this application process, the steaming time has a significant effect on the stain resistance, depending on the SAC. The typical steamer length is approximately 80 linear ft., but can vary. Typical practical limits on steaming time are generally between 0.5 and 4 minutes, i.e., carpet running speed of 20 to 160 ft./min.

Size Exclusion Chromatography (hereinafter SEC) is a well known analytical technique to determine molecular size and is also known as aqueous gel permeation chromatography, as described in pages 81–84 of *A Guide to Materials Characterization and Chemical Analysis*, Edited by John P. Sibilia, published by VCH 1988. Molecular size is measured by hydrodynamic volume defined by elution volume (Ve), sometimes also called retention volume. It is the volume of the material eluted at a certain elution time through the gel permeation apparatus as shown by the chromatography curve, e.g. the area under the peak of the chromatography curve generated while eluting the sample. More specifically, Ve is the peak elution or retention time (on the chromatograph) multiplied by the flow rate of the mobile phase. See Chpt. 10 of *Modern Size Exclusion Liquid Chromatography* by Yau et al., Whiley-Interscience 1979, page 94 of *Thin-Layer Chromatography* by Bolliger et al., Springer-Verlag 1965 and pages 336 to 357, particularly 337 (and page 377) of the *Seminar Proceedings of 6th Int'l Seminar on Gel Permeation Chromatography*, Waters, 1968.

SUMMARY OF INVENTION

This invention relates to an improved method to apply sulfonated aromatic condensates to nylon carpet fiber to impart stain resistance to the fiber by concentrating the sulfonated aromatic condensate near the surface of the fiber by applying the sulfonated aromatic condensate to the fiber in an aqueous solution followed by steaming the fiber. The improvement comprises using a defined elution volume as determined by Size Exclusion Chromatography of between about 6.3 and about 6.5 ml. so that the sulfonated aromatic condensate molecular size is not so small that excess migration into the fiber occurs or swelling agent is required and so that effective stain resistance is achieved. The preferred method is continuous. The preferred method is for a steaming time from about 15 seconds to about 5 minutes and even more preferably from about 30 seconds to about 4 minutes. It is expected that all sulfonated aromatic condensates of elution volume between 6.3 and 6.5 ml. will perform in essentially the same manner. The preferred sulfonated aromatic condensate has the structure

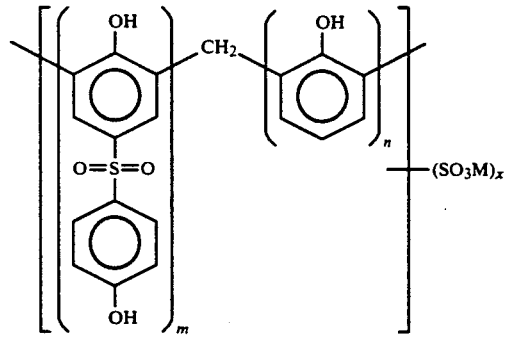

wherein M is an alkali metal cation, x is 0.12–0.30 meq./g. (solids), m is 75 to 15 mole percent and n is 25 to 85 mole percent. Preferably M is sodium, x is 0.255 to 0.285 meq./g. (solids), m is 15–55 mole percent and n is 85–45 mole percent. The preferred SAC is formaldehyde condensed with both a) phenol or its sulfonated derivatives or mixtures thereof and b) 4,4'-diphenolsulfone or its sulfonated derivatives or mixtures thereof. The most preferred sulfonated aromatic condensate is formaldehyde condensed with both a) the sodium salt of para-phenol sulfonic acid and b) 4,4'-diphenolsulfone and/or phenol. The sulfonated aromatic condensate can be applied to the fiber before it is incorporated into carpet or after it is incorporated into carpet. An alternate preferred SAC is formaldehyde condensed with all of a) sodium salt of para-phenol sulfonic acid, b) 4,4'-diphenolsulfone, c) sulfonated 4,4'-diphenolsulfone, and d) phenol.

In a continuous application process with post-steaming, SAC's having molecular size (hydrodynamic volume) defined by elution volume (Ve) determined by Size Exclusion Chromatography (SEC) of between 6.3 and 6.5 ml. using the procedure described herein, are such that they are not too small so that migration into the fiber occurs (reduces ring dyeing effect) nor are they too large such that they require extremely long steaming times or the use of swelling agents to be effective. This is independent of the degree of sulfonation of the SAC.

The SAC compositions impart good stain resistance properties to nylon carpets under the practical ranges of steaming times used in continuous application processes.

DETAILED DESCRIPTION OF THE INVENTION

Figure 1:
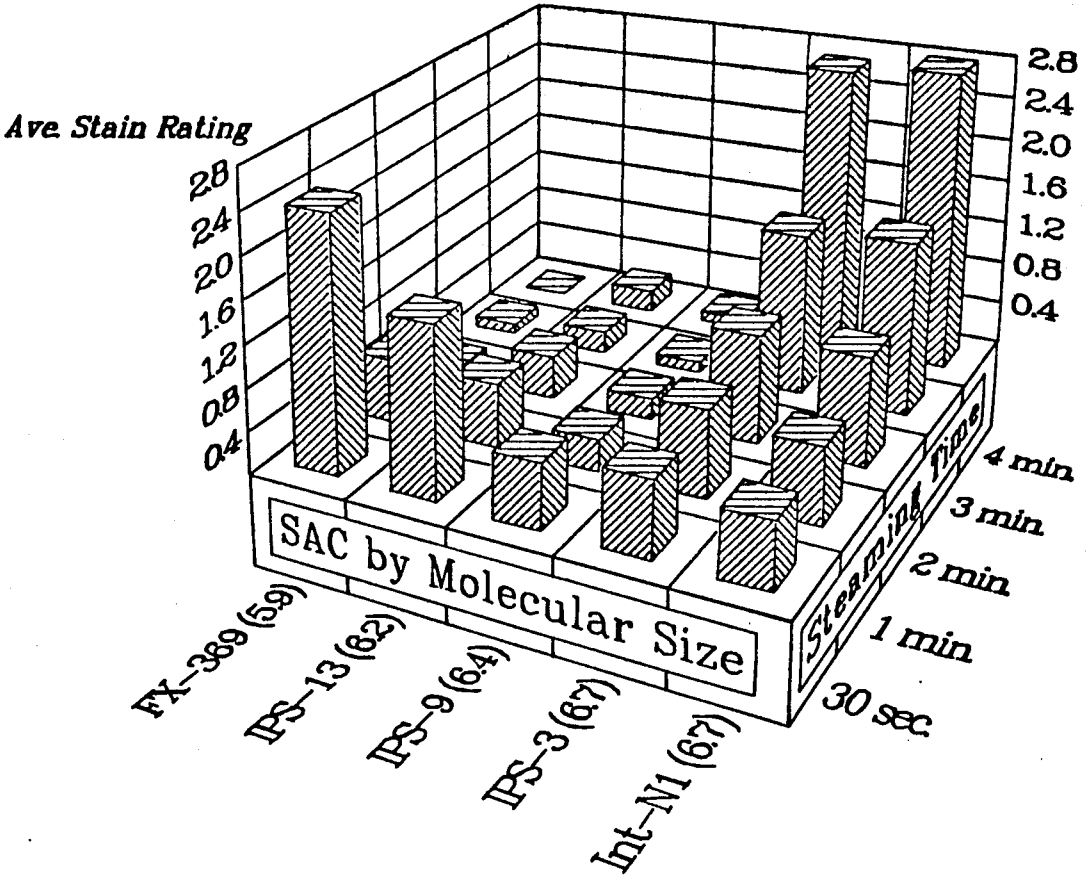
FIG. 1 represents staining results as a function of steaming time versus molecular size, the study of example 1.

In the practice of this invention, the molecular size (hydrodynamic volume) of SAC compositions used to impart stain resistance to nylon carpets must be within a specific range to be continuously applied and subsequently steamed to promote fixation within the fiber. This allows a single SAC composition to impart adequate stain resistance within a practical range of application conditions. These conditions are dictated by the application equipment in use (steamer length) and operating speeds of the steaming apparatus. This is more desirable than having multiple compositions for various processes and reduces manufacturing and inventory costs.

The optimum molecular size range is defined by an elution volume, Ve, determined by analysis using Size Exclusion Chromatography (SEC) of between 6.3 and 6.5 ml. The SAC compositions are prepared by the condensation of formaldehyde with diphenolsulfone, phenolsulfonic acid, and phenol. Other phenolic monomers may also be present, and/or diphenolsulfone or its sulfonated derivative is always present. The general structure is

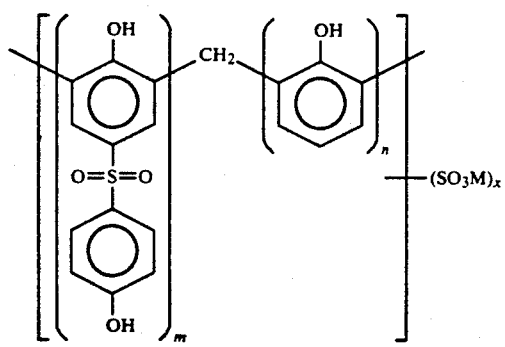

wherein M is an alkali metal cation, x is 0.12 to 0.30 meq/g. (solids), m is 75 to 15 mole percent and n is 25 to 85 mole percent.

The appropriate size of such compositions can be defined only by hydrodynamic volume established by the SEC technique described. The molecular weight distribution of the SAC compositions are very complex and the molecular size does not correlate with the molecular weight or viscosity. This is due to branching of chains across the diphenolsulfone unit along the polymer backbone. The SEC technique was specially developed for this purpose and it excludes the influence of sulfonation level, which is a typical problem when analyzing structures containing the phenolic functionality.

SAC's with a molecular size that is too low exhibit good stain resistance only at very short steaming times. The stain resistance decreases dramatically with increasing steaming times due to reduction of the ring dyeing effect caused by penetration into the fiber. The SAC's of larger molecular size exhibit poorer stain resistance at very short steaming times, but improve as the steaming time increases. A certain amount of steaming is required to sufficiently plasticize or swell the fiber to allow the SAC to penetrate. When the molecular weight is too large, the amount of steaming time required to swell the fiber exceeds the lower practical limits of steaming time. In this case, adequate performance cannot be achieved unless swelling agents are utilized which adds considerable expense. Also, if too large the SAC may not penetrate the fiber and is only on the surface in which case they are not durable and are readily removed upon washing. At extended steaming times (at the upper limit of the practical range), performance is maintained for SAC compositions of higher molecular size of the invention. They are sufficiently large to reduce the rate of penetration into the fiber, thereby maintaining the "ring-dyed" effect. By means of this invention the applicator of the SAC may apply it at an economical steam time without additional expense of swelling agents and achieve an effective stain resistant fiber and/or carpet.

ANALYTICAL AND PERFORMANCE TEST METHODS

Size Exclusion Chromatography

Approximately 0.5% aqueous solution of the stain resist compositions, as supplied (30% SAC solids), in the eluent buffer is injected onto the size exclusion column using the following chromatographic conditions:

Instrument: Varian 5060 Liquid Chromatograph equipped with a Beckman 165 Multi-channel UV/Vis. Detector and a Hewlett-Packard 3390A Reporting Integrator.

Column: Bio-Rad's Bio Sil TSK-400, 300×7.5 mm (13μm). This is a silica based column for gel permeation chromatography with a silica gel coated with a glycol ether phase terminated with hydroxyl groups. TSK indicates the column was manufactured by Toyasota. Column size provided includes length (300 mm), diameter (7.5 mm) and particle size of the packing (13 μm).

Mobile Phase: (eluent buffer) and aqueous solution of 0.05 M CAPS (3-[cyclohexylamino] 1-propanesulfonic acid, Sigma) adjusted to pH 9.0 with NaOH Flow Rate: 1.0 mL/min.

Injection Volume: 20 ul

Detection: UV at 460 nm

The compositions are separated by molecular size (hydrodynamic volume) on a logarithmic scale. The broad polymer peak is characterized by the Elution Volume, Ve. The lower the Ve value, the larger the molecular size.

Stain Test

Carpets were evaluated for staining by applying 30 ml. of a test solution containing 0.056 g/L FD&C Red 40 Dye and adjusted to pH 2.8 with citric acid from a height of 12 inches. The stains were allowed to stand for 4 hours and for 24 hours and were blotted up using a fine water spray to facilitate removal after both the 4 hour and the 24 hour interval. The stain resistance of the carpet is determined by the amount of red color retained by the carpet after the cleaning. The severity of the staining was numerically assessed using a "Red 40

Staining Scale", where 0 is no stain and 8 is severely stained. A rating of less than 0.5 is generally regarded as very good.

DESCRIPTION OF PREFERRED EMBODIMENTS

Example 1

Pilot plant scale evaluations were conducted on a 32 oz./sq.yd. cut pile nylon carpet fabric of T1185-7B66 (Allied) (with built-in fluorocarbon fiber surface) made of Superba heatset yarn that had been dyed into a critical grey shade. The carpets were extracted after dyeing and prior to the SAC treatment via squeeze rolls to 50–55% W.P.U. The SAC stain resist compositions were applied at a nominal level of 0.6% owg, based on solids. The treatment liquors included 1.5 g/L Epsom Salt, were adjusted to a pH of 2.0–2.1 using 1.6–2.1 g/L sulfamic acid and applied at 325% W.P.U. using a Kuster Fluidyer (applicator). The treated carpets were steamed for various times in a laboratory steamer.

Stain Resist compositions

Samples were pulled from the reactor at various times during the condensation of a commercial SAC by Allied-Signal of the above structure where M is sodium, x is 0.27 meq/g.solids, m is 20 mole percent and n is 80. The samples were designated "IPS-3", "IPS-9" and "IPS-13". The sample with the lowest numerical designation was condensed with formaldehyde for the shortest time. Two commercial SAC's were also evaluated, Intratex N (Crompton and Knowles) identified in U.S. Pat. No. 4,501,591 and 4,680,212 both hereby incorporated reference, and FX-369 (3M). Both compositions have a lower sulfonation level than the samples described above and represent a sulfonation level at the other end if the disclosed range (X=0.12–0.15 meq. solids). Other SAC's would be expected to exhibit the same or similar characteristics.

The molecular size of these materials were characterized by SEC. The elution volumes, Ve, are shown in the following table. [The lower the Ve value, the greater the molecular size (hydrodynamic volume).]

| | Ve(SEC) | |
|---|---|---|
| FX-369 | 5.9 | largest molecular size |
| IPS-13 | 6.2 | |
| IPS-9 | 6.4 | |
| IPS-3 | 6.7 | |
| Intratex N | 6.7 | smallest molecular size |

The staining results as a function of steaming time for this study is shown in the table below and FIG. 1, which is a different representation of the same data. This experiment shows that stain resistance performance, an average of the 4 hour and 24 hour staining test described above, is a function of both molecular size and steaming time and independent of the degree of sulfonation of the SAC.

| AVERAGE STAIN RATING (RED 40 SCALE) | | | | | |
|---|---|---|---|---|---|
| | Steaming Time (min.) | | | | |
| SAC | 0.5 | 1 | 2 | 3 | 4 |
| FX-369 | 2.4 | .55 | .14 | .05 | 0 |
| IPS-12 | 1.6 | .63 | .38 | .23 | .18 |
| IPS-9 | .57 | .25 | .14 | .13 | .13 |
| IPS-3 | .65 | .75 | 1.0 | 1.5 | 2.7 |

-continued

| AVERAGE STAIN RATING (RED 40 SCALE) | | | | | |
|---|---|---|---|---|---|
| | Steaming Time (min.) | | | | |
| SAC | 0.5 | 1 | 2 | 3 | 4 |
| Intratex N | .60 | .70 | 1.0 | 1.6 | 2.8 |

The optimum molecular size range to achieve adequate stain resistance properties with the practical limits of commercial steaming times is defined by Ve's of 6.3–6.5 ml.

Study of the table and FIG. 1 shows that only the SAC with molecular size (Ve) of 6.4 ml. will provide acceptable stain resistance values at steaming times commercially acceptable in the field, that is between 15 seconds and 5 minutes, preferably about 30 seconds to about 4 minutes.

Example 2

Laboratory scale evaluations were conducted using a 2.5 inch wide fabric in a plain weave construction (12–13 ends/inch by 11–12 picks/inch). The fabric was woven from a 2 ply Superba heatset yarn of Allied T1189-7B39 fiber and was dyed into a critical grey shade. Various SAC's were applied at a level of 0.5% owg (on weight of goods) on a solids basis. The dry, dyed fabric was dipped in an aqueous solution containing the appropriate concentration of SAC and 2.0 g/L Epsom Salt that has been adjusted to a pH of 2.0 with sulfamic acid. The sample was expressed through squeeze rolls so as to contain 160% wet pick-up (WPU) of solution, based on the weight of the substrate. The treated samples were placed in a laboratory steamer (saturated steam atmosphere at 100° C.) for 5 minutes, rinsed in tap water and air dried.

SAC Compositions: Samples were pulled from the reactor at regular time intervals during the condensation of a commercial SAC by Allied-Signal of the above structure when M is sodium, x is 0.27 meq/g solids, m is 20 mole percent and n is 80 mole percent. The molecular size of these compositions were characterized using the aforementioned Size Exclusion Chromatography technique. Lower Ve values indicate a greater molecular size.

Stain Testing: A 3 inch length of the SAC treated fabric is submersed in 75-mls. of unsweetened Cherry Flavored Kool-Aid (General Foods), diluted according to the package instructions. After 5 minutes, the sample is removed, placed on a non-absorbent surface for 5 hours and then rinsed with ambient temperature tap water.

The degree of staining was determined spectrophotometrically using K/S values at 520 nm., the wavelength of maximum absorbance, which is proportional to the amount of red dye sorbed by the stained test specimen. The test specimens were measured using an ACS Spectro-Sensor spectrophotometer with O/diffuse illumination/measurement geometry using illuminant D65. The K/S value for corresponding non-stained control sample was subtracted from that of the test specimen to compensate for the color associated from dyeing and the "delta K/S value" reported as the degree of staining. Higher delta K/S values indicate a greater degree of staining. Delta K/S values of less than or equal to 0.8 are considered to have good stain resistance and values less than or equal to 0.5 are considered to have excellent stain resistance by this test method.

Discussion

Figure 2:
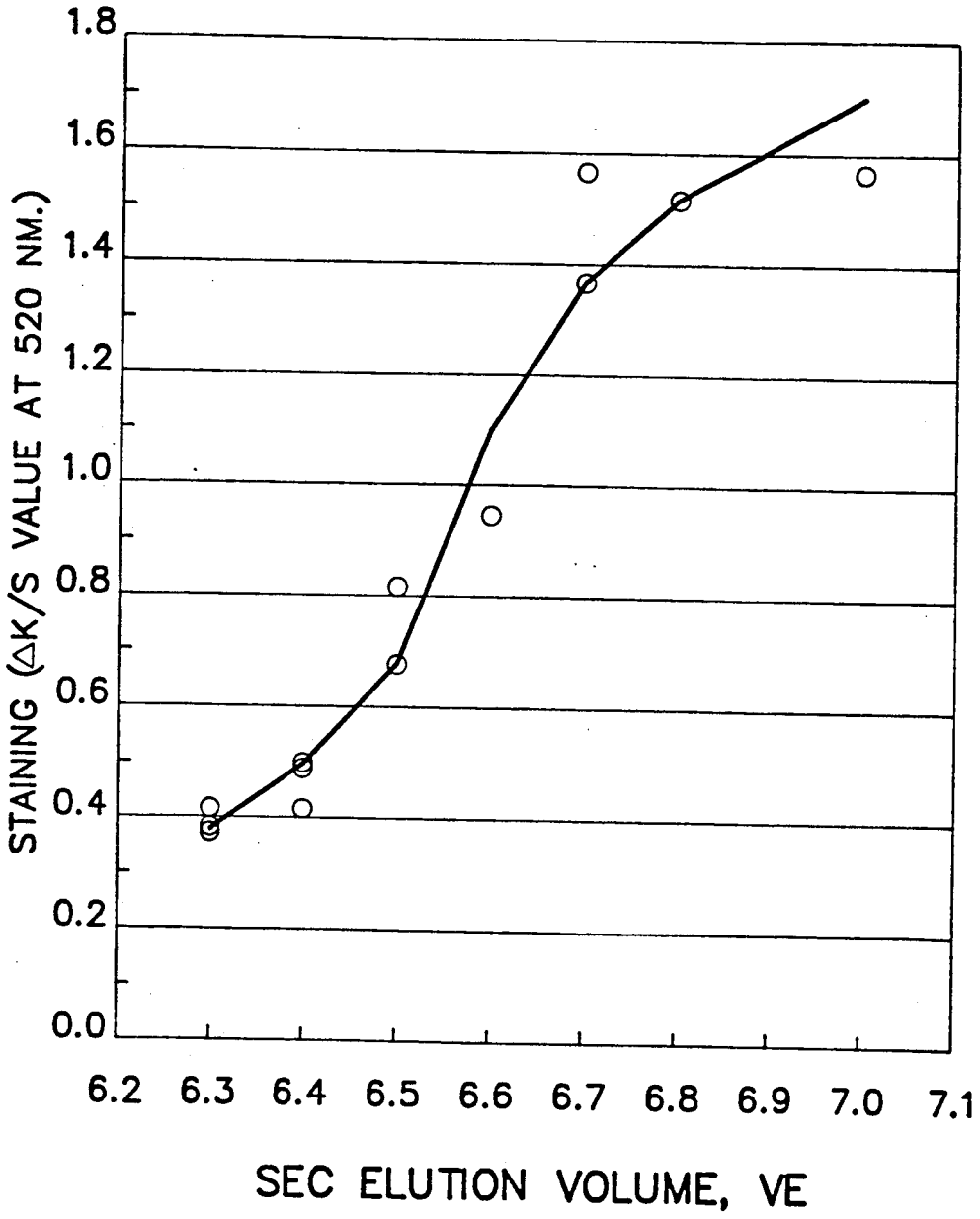
FIG. 2 represents the degree of staining as a function of molecular size, the study of example 2.

The degree of staining for the series of SAC's were plotted as a function of their molecular size (defined by SEC elution volume, Ve, and is shown in FIG. 2. There is a high degree of correlation between molecular size (Ve) and staining (delta K/S value) which fits a 3rd order polynomial having an $R^2$ value of 0.95.

This example shows than the molecular size of the SAC relates to performance as a stain resist agent. SAC's having a molecular size defined by SEC Ve's of less than or equal to 6.5 have good stain resist properties. SAC's of lower molecular size (higher Ve values) are too small and penetrate too far into the fiber cross-section upon extended steaming to provide a sufficient electronic barrier to the anionic staining agent (Cherry Kool-Aid). Higher loadings of the lower molecular size SAC's can be effective for stain resistance, but are uneconomical and exhibit a much greater degree of yellowing upon exposure to light.

Relationship to Example Showing Preferred Embodiment

The above example uses an application protocol which is sensitive only to low molecular size. Further, it cannot be related to steaming times at the lower end of the range typically used in commercial application processes on carpets since the relative mass of the treated substrate within the steamer is much smaller which results in a considerably faster rate of heat transfer.

General Discussion of Synthesis Parameters

In general, two reactions are involved: Sulfonation and Condensation. The sulfonation step is carried out employing sulfur trioxide or any of various derivatives. Certain sulfonating agents, for example acetyl sulfate or chlorosulfonic acid, produce by-products which may need to be removed from the product. Depending on the chosen conditions, the sulfonating agent will be incorporated as both sulfonic acid and sulfone groups. According to general principles of electrophilic substitutions, sulfur is attached in the ortho- or para-positions of the phenol derivatives. The fraction of sulfonic acid critically affects the performance of the SAC when used as a stain resist. A high enough level is required to impart water solubility and to give a product which exhibits desirable electrostatic effects. On the other hand, too high a sulfonation level can lead to a product which is unfavorably distributed between water and the nylon fiber. Choice of the sulfonating agent, the amount charged and the particular reaction conditions are important factors in achieving the desired mixture of intermediates. The ideal composition will depend on the substrate to which the final stain resist is applied, that is, it is different for various types of nylon.

The intermediate product mixture may be isolated, purified and combined in any desired ratio either for further sulfonation or for the subsequent condensation. Alternatively, since both phenolsulfonic acid and sulfonyldiphenol are available in commercial quantities, the sulfonation step can be omitted and condensation carried out with the desired ratio of these commercial products.

The condensation, usually done with formaldehyde, is performed under aqueous conditions at elevated temperature. Because a mixture of phenolic derivatives is charged, it is necessary to find conditions where all monomers are suitably reactive. pH of the condensation medium is the most critical parameter in achieving this compromise. Phenolsulfonic acid is reactive with formaldehyde only at high pH, and sulfonyldiphenol is less reactive under these conditions than at neutral or low pH. In most formulations, base is added to the sulfonation mixture followed by heating with formaldehyde. The presence of sulfonate or sulfone groups makes the condensation reactions sluggish in comparison to the manufacture of other phenolic resins. The resulting methylene groups line the orth- or para- positions of the phenol derivatives.

Aside from the issue of product performance as a stain resist, it is important to achieve good conversion during the condensation step. The residual monomers can adversely affect yellowing and lightfastness properties. In addition, they can cause toxicological problems with the resist formulation itself, in effluent from the fiber treatment process and on the final fiber product. The formaldehyde and base charges are they key reaction parameters to minimize the levels of residual monomers.

I claim:

1. In a method to apply sulfonated aromatic condensates to nylon carpet fiber to impart stain resistance to said fiber by concentrating the sulfonated aromatic condensate near the surface of said fiber by applying said sulfonated aromatic condensate to the fiber in an aqueous solution followed by steaming the fiber, the improvement comprising using a sulfonated aromatic condensate having a molecular size defined by elution volume as determined by size exclusion chromatography of between about 6.3 and about 6.5 ml so that the sulfonated aromatic condensate molecular size is not so small that excess migration into the fiber occurs and not so large that extremely long steaming of the fiber or a swelling agent is required, and so that effective stain resistance is achieved, wherein said sulfonated aromatic condensate has the structure

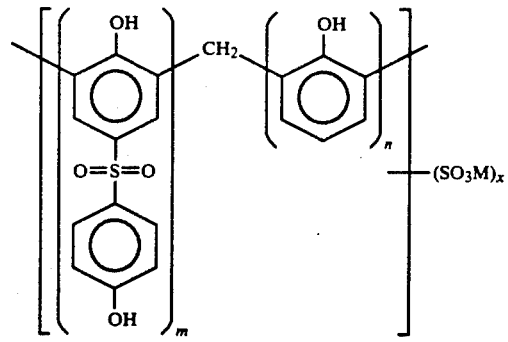

wherein M is an alkali metal cation, x is 0.12 to 0.30 meq/g (100% solids basis), m is 75 to 15 mole percent and n is 25 to 85 mole percent.

2. The method of claim 1 wherein the application is a continuous method.

3. The method of claim 1 wherein the steaming is for from about 15 seconds to about 5 minutes.

4. The method of claim 3 wherein said time is between about 30 seconds and about 4 minutes.

5. The method of claim 1 wherein X is Na, x is 0.85–0.95 meq./g. (30% solids basis), m is 15–55 mole percent and n is 85–45 mole percent.

6. The method of claim 5 wherein the sulfonated aromatic condensate is formaldehyde condensed with both a) phenol or its sulfonated derivatives or mixtures thereof and b) 4,4'-diphenolsulfone or its sulfonated derivatives or mixtures thereof.

7. The method of claim 6 wherein the sulfonated aromatic condensate is formaldehyde condensed with both a) the sodium salt of para-phenol sulfonic acid and b) 4,4'-diphenolsulfone.

8. The method of claim 6 wherein the sulfonated aromatic condensate is formaldehyde condensed with all of a) sodium salt of para-phenol sulfonic acid, b) 4,4'-diphenolsulfone, c) sulfonated 4,4'-diphenolsulfone, and d) phenol.

9. The method of claim 1 wherein the sulfonated aromatic condensate is applied to the fiber before it is incorporated into a carpet.

10. The method of claim 1 wherein the sulfonated aromatic condensate is applied to the fiber after it is incorporated into a carpet.

* * * * *